United States Patent [19]

Kaneko

[11] Patent Number: 4,728,405

[45] Date of Patent: Mar. 1, 1988

[54] PROCESS OF PRODUCING MAGNETIC RECORDING MEDIUM

[75] Inventor: Shiro Kaneko, Kanagawa, Japan

[73] Assignee: Fuji Photo Film Co., Ltd., Kanagawa, Japan

[21] Appl. No.: 847,332

[22] Filed: Apr. 2, 1986

[30] Foreign Application Priority Data

Apr. 3, 1985 [JP] Japan ..... 60-069207

[51] Int. Cl.[4] ..... C25D 13/00; C25D 13/06

[52] U.S. Cl. ..... 204/181.4; 252/62.54; 427/57; 427/128; 428/900

[58] Field of Search ..... 204/181.4; 427/57, 128

[56] References Cited

U.S. PATENT DOCUMENTS 4,414,271 11/1983 Kitamoto ..... 427/57
4,585,535 4/1986 Sher et al. ..... 204/181.4
4,596,739 6/1986 Piltingsrud et al. ..... 427/128
4,604,296 8/1986 Aonuma et al. ..... 427/57
4,634,632 1/1987 Ogawa et al. ..... 427/128

OTHER PUBLICATIONS

Kirk-Othmer Encyclopedia of Chemical Technology, 3rd ed., vol. 14, pp. 743-746.

*Primary Examiner*—Arthur P. Demers
*Attorney, Agent, or Firm*—Sughrue, Mion, Zinn, Macpeak & Seas

[57] ABSTRACT

A process of producing a magnetic recording medium comprises continuously circulating a magnetic coating composition prepared by dispersing a ferromagnetic powder in a solution of a high molecular binder while applying an ultrasonic treatment to the circulating magnetic coating composition, drawing out an amount of the ultrasonically treated magnetic coating composition necessary for coating from the circulating stream, and then coating the magnetic coating composition which is drawn out on to a non-magnetic support.

5 Claims, 3 Drawing Figures

PROCESS OF PRODUCING MAGNETIC RECORDING MEDIUM

FIELD OF THE INVENTION

This invention relates to a process for producing a magnetic recording medium and, more particularly to a process for producing a magnetic recording medium, in which the treatment process for a magnetic coating composition directly before coating is improved.

BACKGROUND OF THE INVENTION

In producing a magnetic recording medium such as a magnetic recording tape, a magnetic recording disc, etc., by a coating process, the magnetic recording medium is generally produced by coating a magnetic coating composition, prepared by dispersing a ferromagnetic powder in a solution of a high molecular binder, on a non-magnetic support and then drying the coating. If foreign matter such as a dispersion of magnetic powder, re-aggregation matter, resinous insoluble matter, etc., exists in the liquid supplying system just prior to coating, it causes dropout, reduction of output, increased noise, etc. therefore, it has been proposed to filter the coating liquid to remove foreign matter.

In FIG. 2, a magnetic coating composition 1, prepared by uniformly dispersing a ferromagnetic powder in an organic solvent solution of a binder, is introduced into a stock tank 2 and travels through a conduit 3 by means of a pump P. The coating composition is filtered by a filter 4 to remove foreign matter. When such a filter is used various conditions such as the nature of the material, the form, etc., of the filter and the viscosity, feeding pressure, flow amount, etc., of the magnetic coating composition are investigated.

To improve the filtering effect in the above-described apparatus, it has been proposed to stir the magnetic coating composition for a long period of time prior to filtering as described in, for example, Japanese Patent Application (OPI) No. 117,737/84 (the term "OPI" as used herein refers to a "published unexamined Japanese patent application").

It has also been proposed to treat a magnetic coating composition with ultrasonic waves in an ultrasonic tank for from about several minutes to about several tens minutes to disperse undispersed matter, reaggregation matter, resinous insoluble matter, etc., before coating the coating composition as disclosed in, for example, Japanese Patent Publication No. 21,331/73 and Japanese Patent Application (OPI) No. 87,303/74.

European Patent Publication No. 85,138 discloses that when treating a magnetic coating composition by ultrasonic waves, if the coating composition is coated after circulating the composition for about 5 hours while applying the ultrasonic treatment that magnetic coating composition can be coated in a stable dispersed state without causing aggregation.

However, the following problems are encountered when using the above-described filter systems.

That is, when the mesh of a filter which is used directly before coating a magnetic coating composition is fine, the above-described problem of the magnetic coating composition at coating is small; but, if the mesh of the filter is too fine, the ferromagnetic powder or materials added for reinforcement are removed by the filtration, whereby the desired performance of the filtration sometimes cannot be obtained. Also, the filter is frequently clogged by magnetic powder, etc., and the filter must be frequently replaced which requires interuption of the coating machine each time. As described above, if the mesh of the filter for use in the filtration procedure is too fine, the production rate of magnetic recording medium is greatly reduced and the workability for the coating operation is very low.

However, in conventional systems which use a filter, the filter must be frequently replaced even when ignoring the production rate and workability to counteract the occurrence of dropout, the reduction of output, the increase of noise, etc. Accordingly, there has been an urgent need to develop a filtration technique capable of prolonging the time between replacing filters used directly before coating a coating composition without damaging the filtration operation.

In the above-described ultrasonic treatment, the problems that occur when using a filter (described above) do not occur since a filter is not used; but, the effects of using a filter are not obtained. To obtain a stabilized dispersion using ultrasonic treatment, a magnetic coating composition must be circulated for about 5 hours while applying the ultrasonic treatment before the magnetic coating composition is coated and, hence, it takes a considerably long period of time to perform the circulation and it is impossible to continuously perform the coating operation for a long period time.

SUMMARY OF THE INVENTION

An object of this invention is to eliminate the above-described problems which occur with conventional techniques and to provide a process for producing a magnetic recording medium capable of greatly prolonging the life of a filter in the case of continuously filtering and coating a magnetic coating composition, and which is also capable of coating the coating composition in the state of a stabilized dispersion.

Another object of this invention is to provide a process for continuously producing a magnetic recording medium without occurrence of dropout, reduction of output, increase of noise, etc.

The inventor has discovered that the above-described objects can be attained in the case of producing a magnetic recording medium wherein the magnetic coating composition is filtered and continuously coated on a non-magnetic support, by circulating a magnetic coating composition while applying thereto an ultrasonic treatment before coating, drawing out a necessary amount of the magnetic coating composition from the circulating stream of the composition at a proper time, e.g., after 20 to 30 minutes, and, after filtering the coating composition thus drawn out, continuously coating the composition on the non-magnetic support.

That is, this invention is a process for producing a magnetic recording medium which comprises; circulating a magnetic coating composition, prepared by dispersing a ferromagnetic powder in a solution of a high molecular binder, while applying thereto an ultrasonic treatment prior to supplying the magnetic coating composition for coating; drawing out the amount of the magnetic coating composition necessary for coating from the circulating stream; filtering the magnetic coating composition which is drawn and continuous coating the magnetic coating composition on a non-magnetic support.

DESCRIPTION OF THE PREFERRED EMBODIMENT

The invention is explained in detail by referring to the accompanying drawings.

Figure 1:
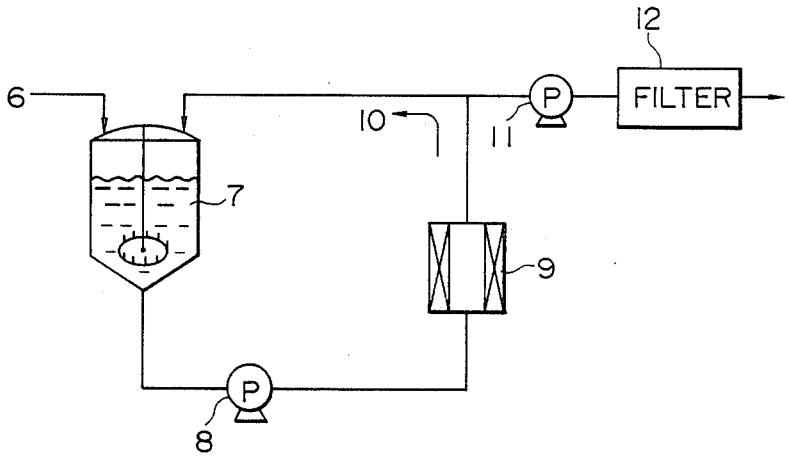
FIG. 1 is a schematic view showing an example of the coating system by this invention.
Figure 2:
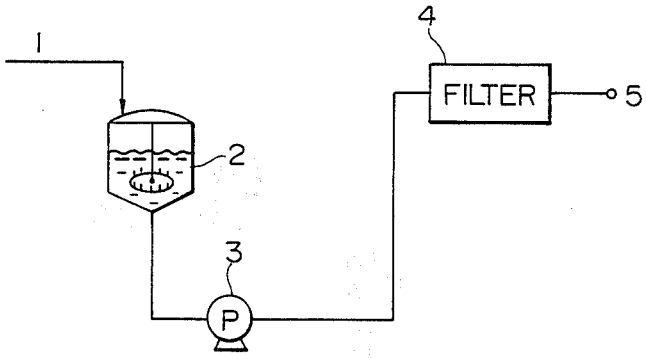
FIG. 2 PRIOR ART
FIG. 2 is a schematic view showing a conventional coating system.

FIG. 1 is a schematic view showing an embodiment of this invention. A magnetic coating composition 6 composed of a uniform dispersion of a ferromagnetic powder in an organic solvent solution of a high molecular binder which is supplied from a previous step is introduced into a stock tank 7 and stored therein. During storage, the magnetic coating composition is stirred by a stirrer for preventing the formation of precipitation, aggregation, etc. Before coating is started, the magnetic coating composition in the stock tank is circulated through an ultrasonic applying device 9 disposed at a conduit system of the circulating system 10 for the magnetic coating composition by means of a supply pump 8 to apply an ultrasonic treatment to the coating composition. After continuing the ultrasonic treatment for, preferably 20 to 30 minutes, amount of the magnetic coating composition necessary for coating is drawn out from the circulating stream of the coating composition by means of a supply pump 11, and after the coating composition is filtered by a filter 12 the coating composition is coated on a non-magnetic support.

In the case of drawing out the necessary amount of the magnetic coating composition from the circulating stream thereof, ultrasonic waves are continuously applied to the circulating stream of the coating composition and, if necessary, a proper amount of additional magnetic coating composition is supplied to the stock tank 7.

The amount of the coating composition to be drawn out from the circulating stream is selected according to the coating speed, the kind of the magnetic recording medium formed, etc., and the magnetic coating composition is continuously drawn out and continuously coated. For example, when a magnetic coating composition is circulated at a rate of about 30 liters/min while applying thereto ultrasonic treatment, the amount drawn out therefrom is preferably about 0.5 to 20 liter/min. The ultrasonic frequency for use in this invention is from about 20 KHz to about 50 KHz.

As the ferromagnetic powders for use in this invention, there are a ferromagnetic iron oxide fine powder, a Co-doped ferromagnetic iron oxide fine powder, a ferromagnetic chromium dioxide fine powder, a ferromagnetic alloy fine powder, a barium ferrite powder, etc. It is effective that the acicular ratio of ferromagnetic iron oxide or chromium dioxide is about 2/1 to 20/1, preferably higher than about 5/1 and the mean length thereof is about 0.2 to 2.0 μm. The ferromagnetic alloy powder contains more than 75% by weight metal component, more than 80% weight of which is a ferromagnetic metal (e.g., Fe, Co, Ni, Fe-Co, Fe-Ni, Co-Ni, Fe-Co-Ni, etc.,) and the long diameter thereof is less than about 1.0 μm.

As the binder for use in this invention, there are thermoplastic resins, thermosetting resins or reactive type resins, and mixtures of the above.

The thermoplastic resins are those having a softening point of lower than about 150° C., a mean molecular weight of about 10,000 to 200,000, and a polymerization degree of about 200 to 2,000. Examples of the thermoplastic resins are a vinyl chloride-vinyl acetate copolymer, a vinyl chloride-vinylidene chloride polymer, a vinyl chloride-acrylonitrile copolymer, an acrylic acid ester-acrylonitrile copolymer, an acrylic acid ester-vinylidene chloride copolymer, an acrylic acid ester-styrene copolymer, a methacrylic acid ester-acrylonitrile copolymer, a methacrylic acid ester-vinylidene chloride copolymer, a methacrylic acid ester-styrene copolymer, a urethane elastomer, polyvinyl fluoride, vinylidene chloride-acrylonitrile copolymer, a butadieneacrylonitrile copolymer, a polyamide resin, polyvinyl butyral, cellulose derivatives (e.g., cellulose acetate butyrate, cellulose diacetate, cellulose triacetate, cellulose propionate, nitrocellulose, etc.,), a styrenebutadiene copolymer, a polyester resin, a chlorovinyl ether-acrylic acid ester copolymer, an amino group, various kinds of synthetic rubber series thermoplastic resins and mixtures of them.

The thermosetting resins or the reactive type resins are those having a molecular weight of less than 200,000 in a state of the coating liquid, said molecular weight becoming infinite by causing a reaction such as a condensation reaction, an addition reaction, etc., after coating and drying. Resins which do not soften or melt before they are thermally decomposed are preferred. Practical examples are a phenol resin, an epoxy resin, a polyurethane hardening type resin, a urea resin, a melamine resin, an alkyd resin, a silicone resin, an acrylic reactive resin, a mixture of a high molecular weight polyester resin and anisocyanate prepolymer, a mixture of a methacrylate copolymer and a diisocyanate prepolymer, a mixture of polyester polyol and polyisocyanate, a urea formaldehyde resin, a low molecular weight glycol, a mixture of a high molecular weight diol and triphenylmethane triisocyanate, a polyamine resin, and mixtures of the above.

These binders are used by themselves or in a combination of the above and, if necessary, other additive(s) may be added thereto. The mixing ratio of the ferromagnetic powder and the binder is 10 to 400 parts by weight, preferably 30 to 200 parts by weight of the binder per 100 parts by weight of the ferromagnetic powder.

An organic solvent is used for dispersing a ferromagnetic powder and coating the magnetic coating composition. Examples of the organic solvent are ketones such as acetone, methyl ethyl ketone, methyl isobutyl ketone, cyclohexanone, etc.; esters such as methyl acetate, ethyl acetate, butyl acetate, ethyl lactate, glycol acetate monomethyl ether, dioxane, etc.; aromatic hydrocarbons such as benzene, toluene, xylene, etc., chlorinated hydrocarbons such as methylene chloride, ethylene chloride, carbon tetrachloride, chloroform, ethylenechlorohydrin, dichlorobenzene, etc. These organic solvents may be used individually or as a mixture of the above.

The magnetic coating composition for use in this invention may contain additives such as lubricants, abrasives, dispersing agents, antistatic agents, rust inhibitors, etc. Examples of the lubricants are saturated or unsaturated higher fatty acids, fatty acid esters, higher fatty acid amides, higher alcohols, silcone oils, mineral oils, vegetable oils, fluorine compounds, etc., and they may be added at the time of preparation of the magnetic coating composition or may be sprayed as a solution thereof in an organic solvent on the surface of a magnetic recording layer after drying, smoothing, or hardening by electron irradiation.

As a material for the support on which the magnetic coating composition is coated, there are polyesters such as polyethylene terephthalate, polyethylene-2,6-naphthalene, etc.; polyolefins such as polyethylene, polypropylene, etc.; cellulose derivatives such as cellulose triacetate, etc.; and other plastics such as polycarbonate, polyimide, polyamidoimide, etc.; as well as sheets of non-magnetic metals such as aluminum, copper, tin, zinc, or alloys thereof; plastic films vapor-deposited with a metal such as aluminum; papers; papers coated or laminated with a polyolefin, etc.

The non-magnetic support may be a film, tape, sheet, disc, card, drum, etc., and the various materials described above may be suitably selected according to the type of support.

The support for use in this invention may have a back coat for the purposes of static prevention, transfer prevention, prevention of the occurrence of wow and flutter, improvement of the strength of the magnetic recording medium, matting of the back surface, etc., on the surface opposite to the side having a magnetic layer.

EXAMPLE

The invention is further explained by the following example. Unless otherwise indicated, the amount listed are in parts by weight.

| | |
|---|---|
| Fine alloy powder (Fe-Zn 95:5, particle size 0.3 μm, coercive force 1,200 Oe) | 100 parts |
| Copolymer of vinyl chloride, vinyl acetate, and vinyl alcohol (ratio 92:3:5, polymerization degree 400) | 12.5 parts |
| Polyester polyurethane (molecular weight about 30,000) | 7.5 parts |
| Oleic acid | 2 parts |
| n-Butyl stearate | 1 part |
| α-Alumina | 2 parts |
| Carbon black (mean particle size 10 μm) | 2 parts |
| Methyl ethyl ketone | 200 parts |
| Cyclohexanone | 100 parts |

After sufficiently dispersing the above-described mixture in a batch-type sand grinder, 6.7 parts by weight of a triisocyanate compound (Coronate L-75, trade name, made by Nilpon Polyurethane Co.) was added, and they were mixed.

The magnetic coating composition thus obtained was stored in stock tank of the apparatus shown in FIG. 1 and circulated through an ultrasonic irradiation device 9 using a piezoelectric ultrasonic oscillator (Blanson systen Langevin type) at a flow rate as shown in Table 1 to apply ultrasonic waves to the liquid at a frequency and output as shown in Table 1.

TABLE 1

| Sample No. | Flow rate of circulation* | Flow amount of drawing out** | Frequency | Output (volts) |
|---|---|---|---|---|
| (1) | 30 l/min | 0.5 l/min | 40 KHz | 200-120 |
| (2) | 30 l/min | 1 l/min | 40 KHz | 200-120 |
| (3) | 30 l/min | 10 l/min | 40 KHz | 200-120 |
| (4) | 30 l/min | 20 l/min | 40 KHz | 200-120 |
| (5) | 2 l/min | 0.5 l/min | 33 KHz | 100-70 |
| (6) | 2 l/min | 1 l/min | 33 KHz | 100-70 |

*amount of circulated magnetic coating medium
**amount of magnetic coating medium drawn out for coating After circulating the magnetic coating composition for about 30 minutes, a part of the circulating stream of the magnetic coating composition was continuously drawn out by means of a pump in an amount shown in Table 1 above, introduced to a coating device through a filter (Pole filter, made by Pole Co.), coated on a polyethylene terephthalate film of 22 μm in thickness and 0.1 μm in surface roughness at a dry thickness of 3 μm, and after applying thereto a magnetic orientation, dried to provide a magnetic tape sample.

COMPARATIVE EXAMPLE

Comparison samples were prepared by coating the magnetic coating composition having the formula described above with coating after applying the filter operation only (without performing the above-described circulation treatment) and with coating after applying the ultrasonic treatment and filter treatment (without performing the circulation treatment).

Figure 3:
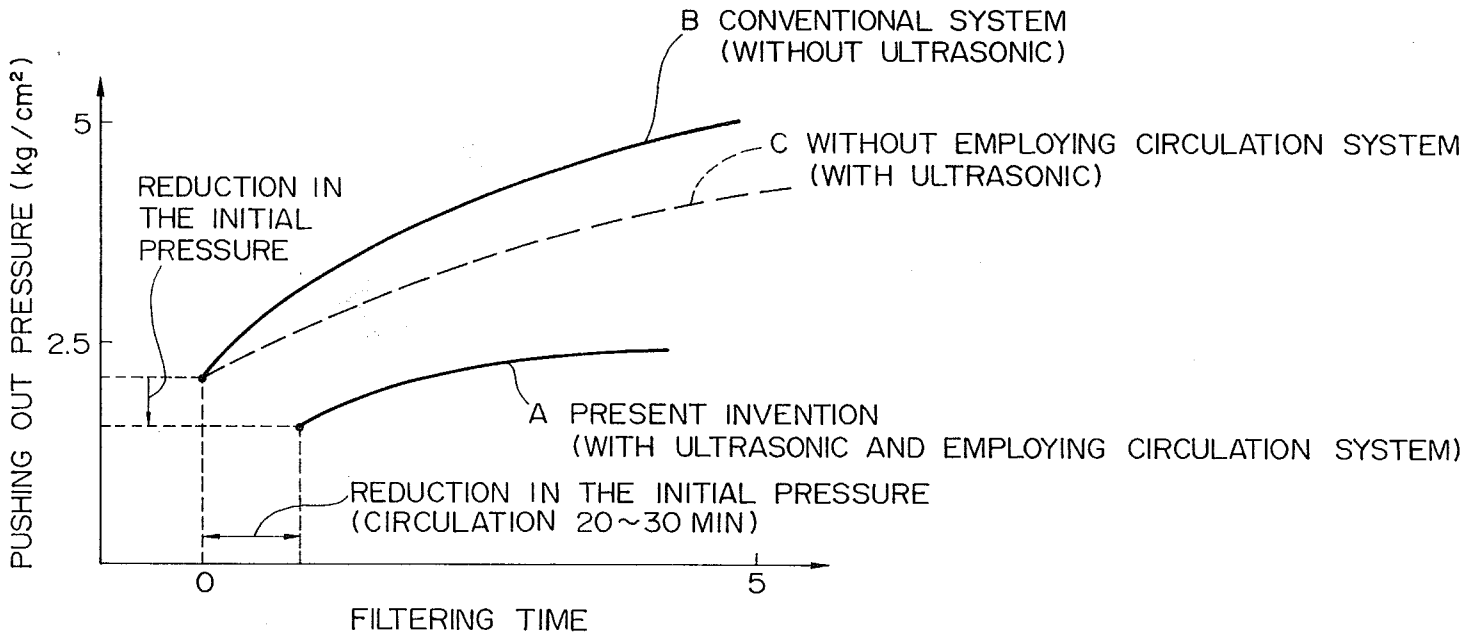
FIG. 3 is a graph showing the relation between the filtering time and the pushing out pressure through the filter.

The relationship between the pushing out pressure for the filter and the filtering time is shown in FIG. 3.

In the experiments, clogging of the filter gradually increased during the filtration treatment. When the pushing out pressure of the coating composition through the filter was over 5 kg/cm$^2$ there was a possibility that a conduit might be broken or foreign matter larger than the mesh of the filter would forcibly pass through the filter so the filter had to be replaced when the pushing out pressure reached near 5 kg/cm$^2$.

As is seen from the results shown in FIG. 3, in the conventional system B wherein the magnetic coating composition is not circulated and ultrasonic treatment is not applied, the pushing out pressure reached 5 kg/cm$^2$ after about 5 hours and the filter had to be renewed. In system C of wherein the ultrasonic treatment was applied without circulating the magnetic coating composition, the pushing out pressure reached 5 kg/cm$^2$ after about 10 hours. In contrast, in case A per the invention, the pushing out pressure reached 5 kg/cm$^2$ after about 15 hours and, hence, the life of the filter was greatly prolonged.

As is seen from the above, by employing the circulation system of this invention, the following merits are obtained:

(1) The initial pressure on the filter is reduced.

(2) By the reduction of the initial pressure on the filter, the time between replacing filters can be prolonged and the life of the filter can be greatly prolonged. Accordingly, the workability (such as the frequency for the replacing of the filter, etc.) and the producibility of magnetic recording media (number that can be produced, etc.) can be greatly improved.

(3) The magnetic recording media produced by the process of this invention have greatly improved performance such as an increase of squareness ratio, an improvement of luster, a reduction of surface roughness, etc.

In addition, the reason why the above-described great improvement of filterability of magnetic coating composition and the performance of magnetic recording media is obtained by employing the process of this invention is considered to be that a dispersion of magnetic powder, resinous insoluble matter, re-aggregation, etc., are uniformly re-dispersed by applying the ultrasonic treatment to the magnetic coating composition while circulating the coating composition.

While the invention has been described in detail and with reference to specific embodiments thereof, it will be apparent to one skilled in the art that various changes and modifications can be made therein without departing from the spirit and scope thereof.

What is claimed is:

1. A process of producing a magnetic recording medium, comprising:

continuously circulating a magnetic coating composition prepared by dispersing a ferromagnetic powder in a solution of a high molecular binder while applying an ultrasonic treatment to the circulating magnetic coating composition;

drawing out and filtering an amount of the ultrasonically treated magnetic coating composition necessary for coating from the circulating stream; and then coating the magnetic coating composition which is drawn out on to a non-magnetic support.

2. A process as claimed in claim 1, wherein the drawing out of the magnetic coating composition from the circulating magnetic coating composition is carried out for the first time after circulating the magnetic coating composition for at least about 20 minutes.

3. A process as claimed in claim 2, wherein the drawing out of the magnetic coating composition from the circulating magnetic coating composition is carried out for the first time after circulating the magnetic coating composition for about 20 to 30 minutes.

4. A process as claimed in claim 1, wherein when the magnetic coating composition is circulated in an amount so that 30 l/min undergoes ultrasonic treatment the magnetic coating composition to be coated on the non-magnetic support is drawn out from the circulating magnetic coating composition in an amount of about 0.5 to 20 l/min.

5. A process as claimed in claim 1, wherein the ultrasonic frequency is 20 to 50 KHz.

* * * * *